United States Patent [19]

Wunsche

[11] Patent Number: 4,679,773

[45] Date of Patent: Jul. 14, 1987

[54] HORIZONTAL TAPPING FURNACE AND METHOD OF OPERATION

[76] Inventor: Edgar R. Wunsche, 682 Bermuda, Oshawa, Ontario, Canada, L1J 6A8

[21] Appl. No.: 782,136

[22] Filed: Sep. 30, 1985

[51] Int. Cl.[4] ..... C21B 11/00

[52] U.S. Cl. ..... 266/45; 266/217; 266/240; 266/272

[58] Field of Search ..... 266/45, 271, 217, 236, 266/240, 272; 222/603, 597, 590, 591

[56] References Cited

U.S. PATENT DOCUMENTS

| | | | |
|---|---|---|---|
| 2,426,644 | 9/1947 | Van Der Pyl | 266/240 |
| 2,982,534 | 5/1961 | Meffert | 222/597 |
| 3,581,948 | 6/1971 | Detalle | 222/603 |
| 3,783,169 | 1/1974 | Newhall | 266/240 |
| 4,232,855 | 11/1980 | Hartl | 266/272 |
| 4,457,459 | 7/1984 | Bates et al. | 222/597 |

FOREIGN PATENT DOCUMENTS

| | | | |
|---|---|---|---|
| 2104561 | 3/1972 | Fed. Rep. of Germany | 222/603 |

*Primary Examiner*—L. Dewayne Rutledge
*Assistant Examiner*—S. Kastler
*Attorney, Agent, or Firm*—Bachman & LaPointe

[57] ABSTRACT

The tapping passage of a metallurgical furnace is disposed generally horizontally in a lower region of the furnace wall structure below the upper level of the liquid metal; a closure member is pivotally movable relative to an outer end of the tapping passage to open and close access to the passage; the closure has a gas injection nozzle for injecting air under low pressure into the tapping passage to remove temporary plugging material in said passage in preparation for discharge of the liquid metal.

13 Claims, 7 Drawing Figures

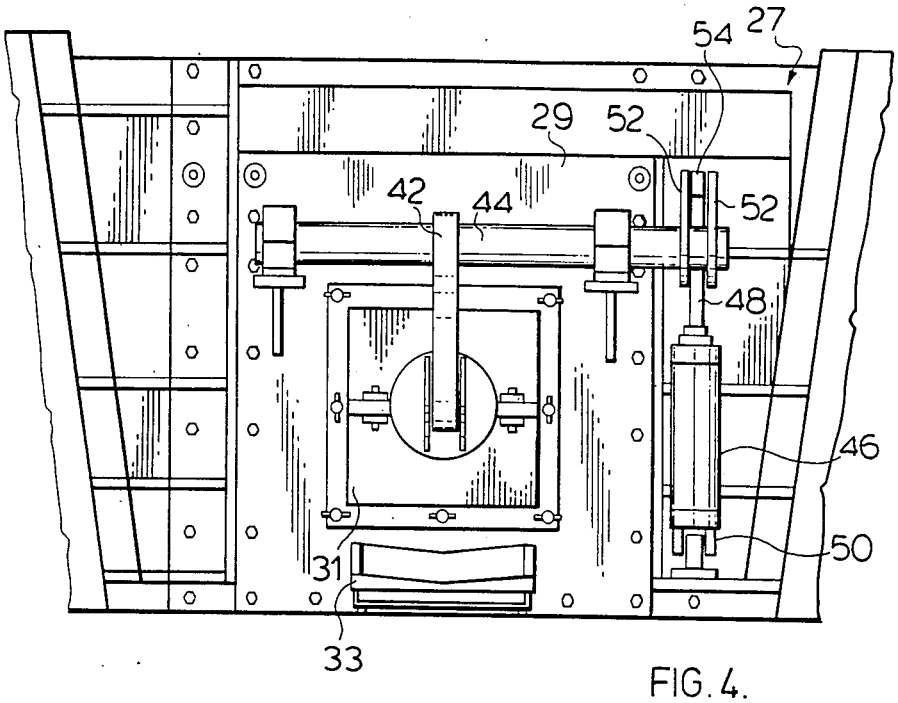
FIG. 4.
FIG. 5.
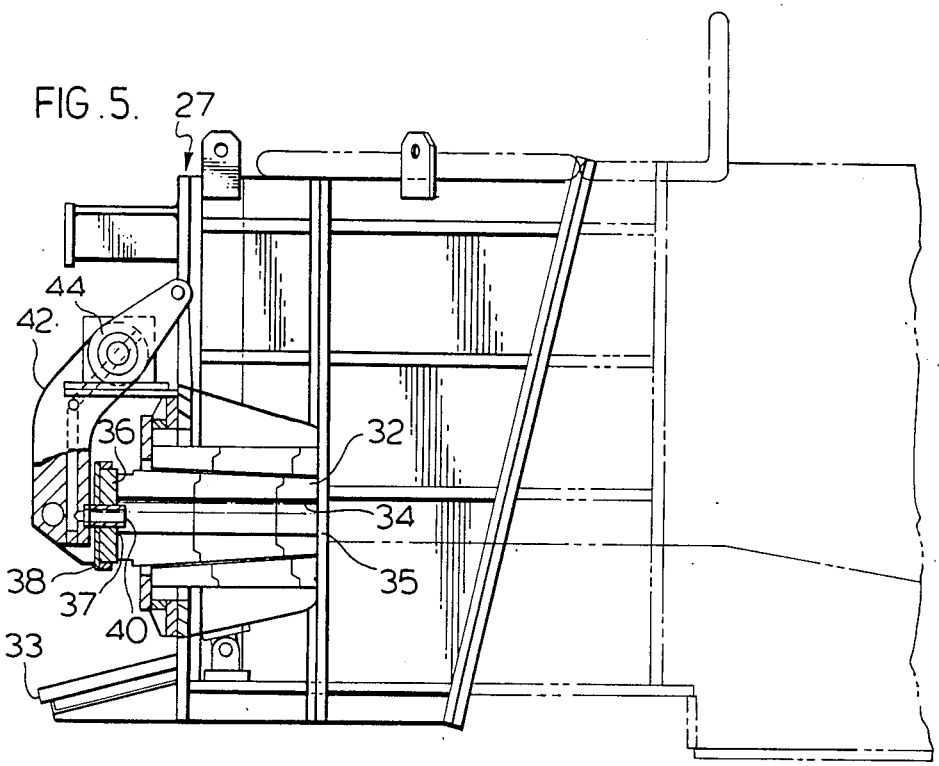

HORIZONTAL TAPPING FURNACE AND METHOD OF OPERATION

BACKGROUND OF THE INVENTION (a) Field of the Invention

This invention relates to an assembly for tapping of liquid metal from a metallurgical furnace and to an improved metallurgical furnace.

(b) Brief Description of the Prior Art

The Electric Arc Furnace is widely employed in steel production.

Initially the design of the Electric Arc Furnace was such that molten metal, especially steel was poured from the furnace, together with liquid slag into a ladle from a permanently open tapping hole or spout located above the slag line. Draining of the molten metal and liquid slag after each heat in the furnace necessitated tilting the furnace through an angle of 43° to 45° to the vertical.

A subsequent development was to employ a temporarily plugged tap hole above the slag line and effecting a discharge of the liquid slag through a separate outlet, before unplugging the tap hole for discharge of the molten metal. In general the same tilting angle was employed and some residual slag was entrained in the molten metal during the tapping.

It is increasingly desirable that the molten steel be tapped or poured from the furnace essentially free of the liquid slag formed in the furnace. Different systems have been developed in an attempt to achieve this. The most successful systems have been so-called Eccentric Bottom Tapping Systems. These systems employ a tap hole oriented vertically, through the extended bottom of the furnace hearth.

By consideration of the volume of molten metal which has a predetermined upper level in the furnace, and careful control of the amount discharged, an essentially slag-free discharge can be made completely below the slag line.

This vertical arrangement has, however, the particular disadvantage that it generally requires substantial modification to the furnace foundation, platform and ladle handling equipment.

Moreover, vertical orientation of the tap hole requires that work on the discharge side of the tap hole must be carried out under the furnace, which results in increased danger for operating and maintenance crews. Typically the tap hole has a temporary plug of refractory material which is sintered to form a solid plug. When the tap hole flap or door is opened the solid plug must be removed. The hazardous nature of the overhead work beneath the furnace is especially apparent when the solid plug does not fall clear of the tap hole when the tap hole flap or door is opened, and an oxygen lance or a rod is employed from below to clear the tap hole.

It is an object of this invention to avoid the dangers and disadvantages associated with the vertically oriented tap hole, while at the same time providing an essentially slag-free discharge of liquid metal.

It is a further object of this invention to provide an assembly for tapping of liquid metal from a furnace, whereby access to the tap hole can be readily and safely opened and closed.

It is still a further object of this invention to provide such an assembly including means for readily and safely displacing a temporary plug of refractory material from the tap hole, for discharge of liquid metal from the furnace.

It is yet another object of this invention to provide an improved metallurgical furnace, especially an Electric Arc Furnace, having an essentially horizontal tapping passage in the furnace wall below the slag line.

SUMMARY OF THE INVENTION

In accordance with one aspect of the invention a metallurgical furnace has a tapping passage for delivery of liquid metal therethrough by tilting the furnace. The tapping passage is disposed generally parallel to a horizontal axis of the furnace, when the furnace is in a non-tilted, normal upright position. The essentially horizontal tapping passage is disposed vertically below a predetermined upper level of liquid metal in the furnace and in particular is in a lower region of the furnace wall.

Discharge of slag-free liquid metal can be effected by tilting the furnace about its horizontal axis by a relatively small angle, typically not more than 15° and suitably 12.5° to the vertical.

In another aspect of the invention there is provided a tapping assembly for a metallurgical furnace which includes a refractory member having a tapping passage therethrough. The refractory member is to be mounted in the wall of the furnace. The passage has a spout end, and the assembly includes a spout closure which is movable relative to the spout to open and close the spout.

The closure is, in particular, mounted for pivotal movement in a frame which supports the closure member.

BRIEF DESCRIPTION OF THE DRAWINGS

The invention is illustrated in particular and preferred embodiments by reference to the accompanying drawings in which:

FIG. 4 is an end view of the tapping assembly shown in FIG. 1;

FIG. 5 is a side view of the tapping assembly shown in FIG. 1;

Figure 1:
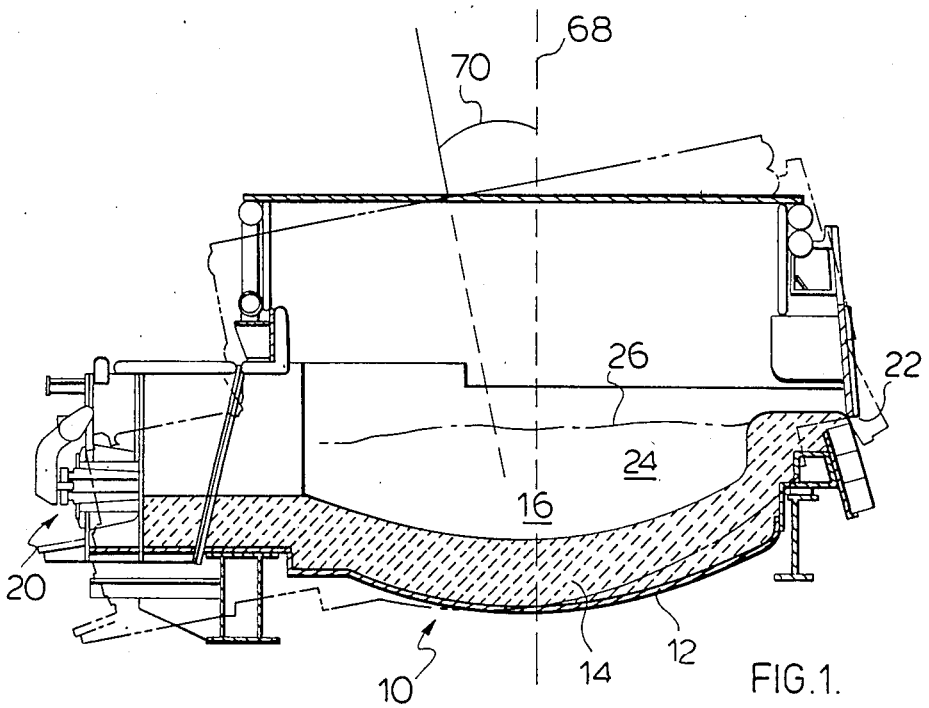
FIG. 1 illustrates schematically a furnace of the invention in the normal position, the tilted position for tapping being shown in dotted outline.
Figure 2:
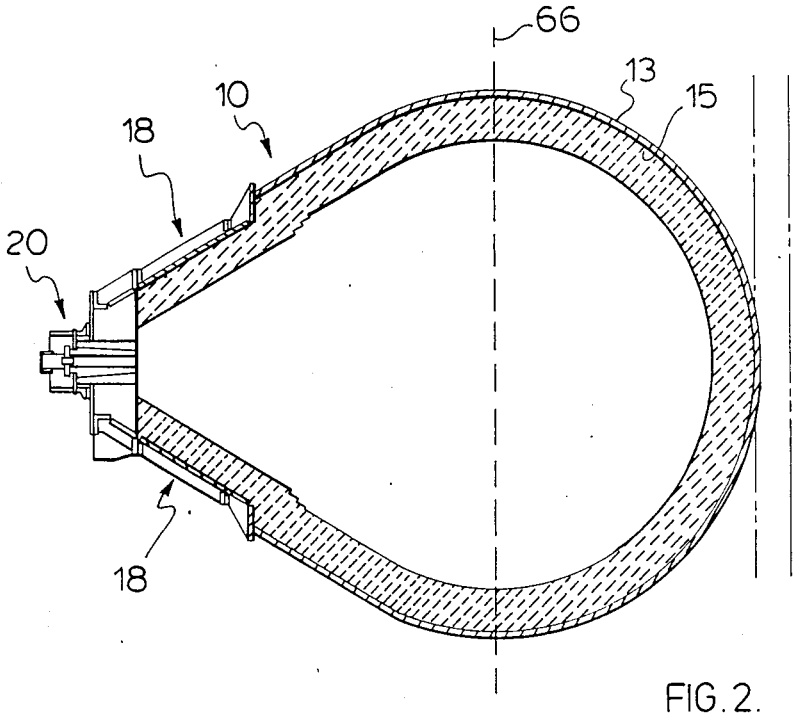
FIG. 2 is a top plan view of the furnace of FIG. 1.

With further reference to FIGS. 1 and 2 a furnace 10, which is in particular an Electric Arc Furnace, has a floor 12 with a refractory bottom 14 and a wall 13 extending generally upwardly about the floor 12 and having a refractory lining 15. A hearth zone 16 is defined above refractory bottom 14.

Furnace 10 has a generally horizontal axis 66 of tilting, a vertical axis 68 and an angle of tilt 70.

A pair of spout panels 18 extend towards each other along opposed sides of furnace 10 and a tapping assembly 20 is disposed between their ends.

Furnace 10 includes a slag outlet 22 remote from tapping assembly 20.

As shown in FIG. 1, furnace 10 includes a bath 24 of liquid metal in hearth zone 16, the bath 24 having an upper horizontal level 26.

Figure 3:
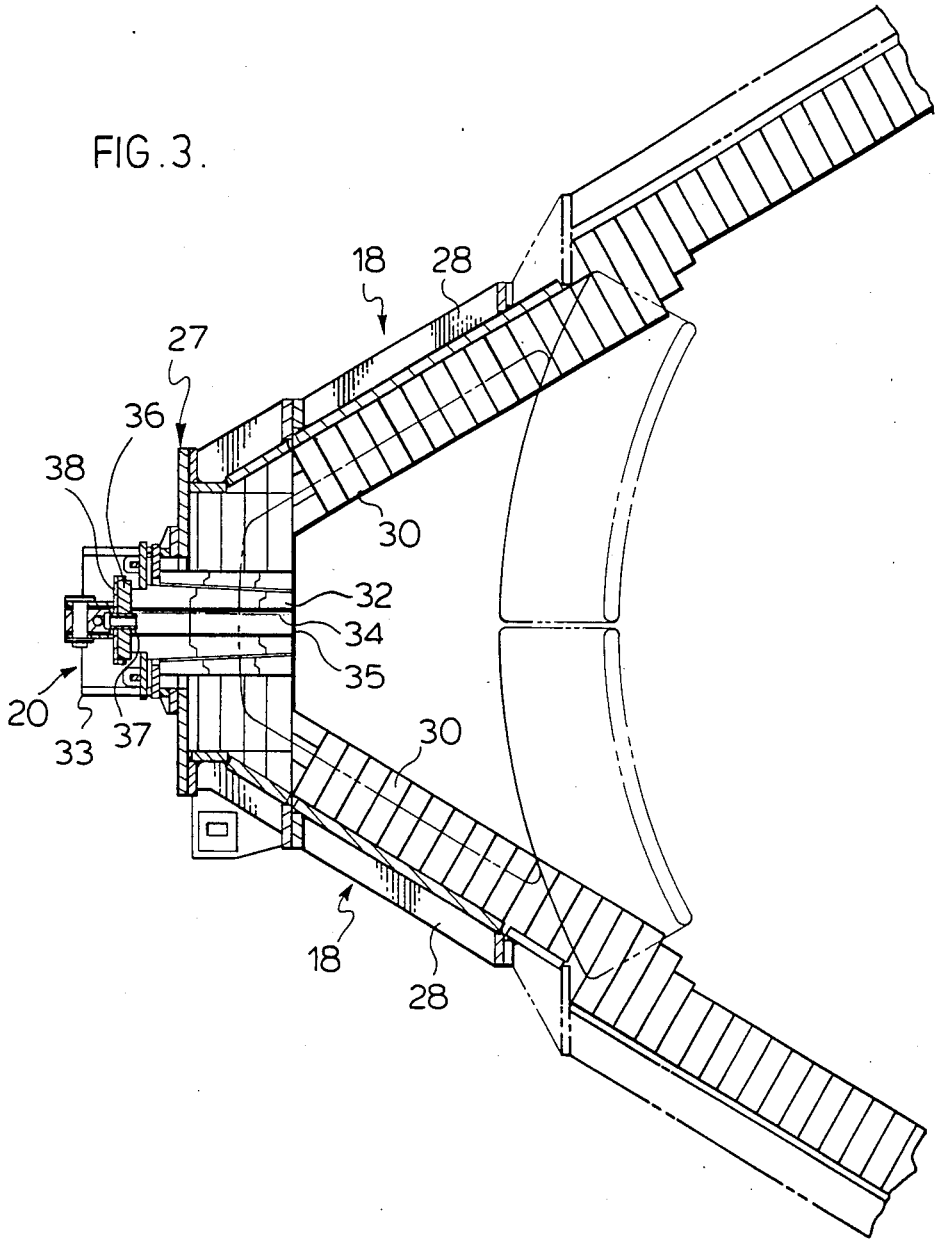
FIG. 3 is a top plan view of a portion of the furnace of FIG. 1, incorporating the tapping assembly of the invention.

With further reference to FIGS. 3 to 5, there is shown details of the tapping assembly 20 and adjacent spout panels 18.

With particular reference to FIG. 3, spout panels 18 include panel members 28 and a refractory lining 30.

Tapping assembly 20 includes a spout frame 27 having a heat shield 29. A tubular refractory block 32 defining a tapping passage 34 having an inner end 35 and an outer spout end 37 extends through heat shield 29 and between the refractory lining 30 and is held in place by a clamping plate 31 secured to heat shield 29. As shown in FIG. 3, spout end 37 is closed by an annular spout closure 36 mounted in a closure frame 38.

A tubular nozzle 40 extends through closure 36 into tapping passage 34.

With further reference to FIGS. 4 and 5, tapping assembly 20 further includes an arm 42 rigidly mounted on a rotatable shaft 44, for rotation therewith in frame 27. A hydraulic cylinder 46 is mounted at a lower end by a clevis bracket 50 on frame 27 and includes a slidable piston 48 connected at its outer end by a pin 54 between brackets 52 rigidly mounted on shaft 44, for rotation therewith.

A drip tray 33 is disposed outwardly of shield 29 below spout end 37.

Figure 6:
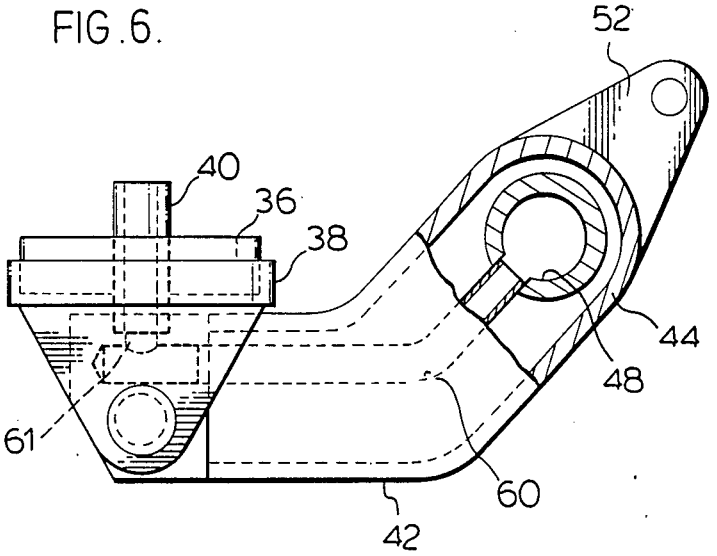
FIG. 6 is a side view of a detail of the tapping assembly.
Figure 7:
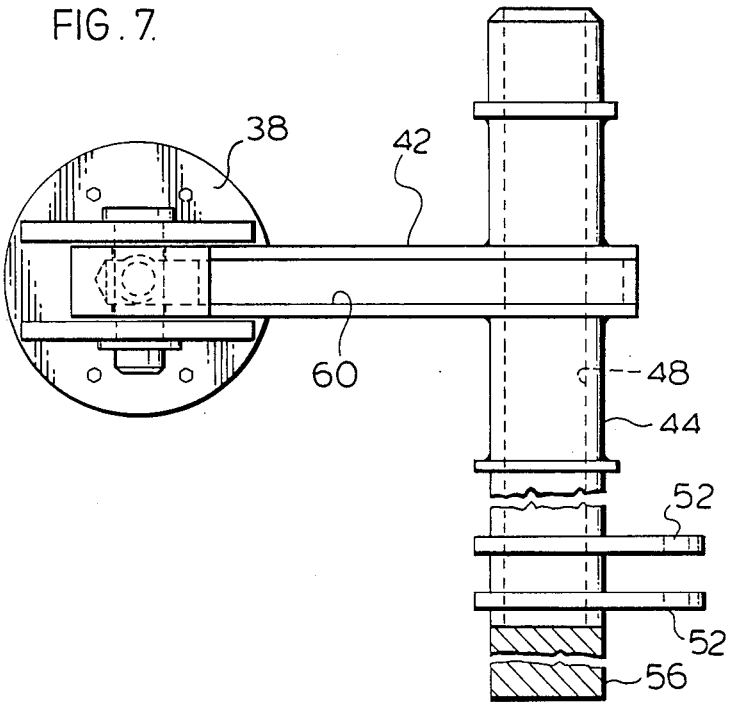
FIG. 7 is a top plan view of a detail of the tapping assembly.

With further reference to FIGS. 6 and 7 shaft 44 has a tubular passage 48 which communicates with a gas conduit 60 in arm 42. Gas conduit 60 is connected by a connection conduit 61 with tubular nozzle 40. A high pressure impulse source 56 is associated with shaft 44 for introduction of an impulse of air through tubular passage 58, gas conduit 60 and connection conduit 61 for injection into tapping passage 34 through tubular nozzle 40.

The tapping passage 34 is generally frustoconical, with the converging taper being from the spout end 37 to the inner end 35.

In operation of the furnace 10 the tapping passage 34 is first opened. This is achieved by means of hydraulic cylinder 46 and its piston 48. Piston 48 is drawn into cylinder 46 thereby rotating shaft 44 in a clockwise direction (as viewed in FIG. 5), to pivot arm 42 away from spout end 37, whereby closure 36 moves away from spout end 37 to provide access thereto.

Tapping passage 34 is filled by ramming in a temporary refractory plugging material to close it and hydraulic cylinder 46 is actuated to rotate shaft 44 in an anticlockwise direction (as viewed in FIG. 5), and pivot arm 42 towards spout end 37 whereby annular spout closure 36 closes passage 34 at spout end 37.

A melt of metal such as steel is formed in furnace 10 in conventional manner, and this results in formation of a bath 24 of liquid metal having an upper level 26 in hearth zone 16, a layer of slag being formed above the bath 24 on level 26.

In order to discharge liquid metal from the furnace 10, the furnace 10 is first tilted from its normal upright position about horizontal axis 66 to lower slag outlet 22, so that it is inclined downwardly of horizontal axis 66, whereby the layer of liquid slag is discharged from furnace 10.

Furnace 10 is restored to its normal upright position. An impulse of air suitably having a pressure of 60 to 100 psi is dispatched from source 56, through tubular passage 58, gas conduit 60, connection conduit 61 and tubular nozzle 40 into tapping passage 34 and serves to discharge the temporary refractory plugging material in passage 34.

Spout closure 36 is then moved away from outer end 37 in the manner previously described, furnace 10 is tilted about horizontal axis 66 to an angle of tilt 70 which is typically less then 15° and suitably about 12½° whereby tapping passage 34 is moved from its normal generally horizontal position, parallel to horizontal axis 66, to a downwardly directed position, and liquid metal in bath 24 can flow outwardly to an appropriate ladle or collecting vessel (not shown).

The location of tapping passage 34 horizontally of the furnace 10 in the wall 13 facilitates access to the tapping passage and permits workers to approach the tapping area without danger. The tapping passage 34 is located below level 26 in a lower part of wall 13.

The use of the impulse jet to clear the temporary plugging material also facilitates the operation of the furnace 10, speeds up the operation and avoids the danger associated with vertical tapping passages in the floor of the furnace.

It was surprising that a relatively low pressure jet of air provided by source 56 would suffice to clear passage 34 of the temporary plugging material. It appears that in practice only an innermost part of the plugging material sinters together to a solid block and the remainder remains in a substantially non-sintered, particulate form.

The spout closure 36 is of refractory material and serves to close spout end 37 and retain the temporary plugging material to passage 34. Closure 36 is replaceable in closure frame 38.

The impulse jet from source 56 can also be used to clean passage 34 of residual liquid metal or slag which may remain in passage 34 after discharge of metal.

Existing furnaces can be modified by removing a sector of wall panels to form a side opening and attaching spout panels 18 to the furnace wall panels adjacent the side opening to complete the wall and define an extension of the furnace. The tapping assembly 20 is secured between the outer ends of spout panels 18 and the floor of the furnace is extended into the extension.

The extension of the furnace formed by the spout panels 18 and the extended floor serves additionally to increase the useful volume of existing furnaces by 10 to 15%.

The spout panels 18, tapping assembly 20 and the floor extension can be supplied as a unit or module.

By means of the invention it is possible to shorten the time between tapping because of the ease of clearing and cleaning the tapping passage, and the ready discharge and collection of the liquid metal without the need for operation beneath the furnace floor which requires platforms and special ladle handling equipment, so that the furnace is elevated relative to the ground.

I claim:

1. An assembly for tapping a liquid metal from a metallurgical furnace comprising a refractory member adapted to be mounted in a furnace wall, said member having a tapping passage therethrough, said passage having an inner end adapted to communicate with the interior of the furnace, a molten metal discharge outlet at an outer end, said outlet defined by an outwardly facing passage wall and said passage at said outer end, a closure mounted externally of said passage and having a closure surface, said closure being movable relative to said discharge outlet towards said inner end to a first position in which said closure surface engages said passage wall at said outer end to fully close said discharge outlet and away from said inner end to a second position spaced apart from said passage wall, and gas conduit means extending through said closure for injection of gas into said tapping passage, said gas conduit means including a gas inlet adapted to communicate with a source of gas.

2. An assembly according to claim 1, wherein said closure is mounted for pivotal movement to open and close said discharge outlet.

3. An assembly according to claim 2, further including a supporting frame, a shaft mounted for rotary movement in said frame and a closure arm rigidly mounted on said shaft, said closure being mounted on said arm.

4. A metallurgical furnace having a furnace floor and a furnace wall, means extending generally upwardly about said floor, said furnace having a vertical axis and a horizontal axis and being mounted for pivotal tilting movement about said horizontal axis.

a hearth zone defined between said floor and wall means adapted to house a bath of liquid metal, said hearth zone defining a predetermined upper level for said bath, a tapping assembly mounted in said wall means, comprising a refractory member having a tapping passage therethrough, said passage having an inner end adapted to communicate with said hearth zone and a liquid metal discharge outlet, said outlet being defined by an outwardly facing passage wall and said passage at said outer end, said tapping passage being disposed generally parallel to said horizontal axis, in said non-tilted position, vertically below and remote from said predetermined upper level in a lower-most region of said hearth zone such that a head of liquid metal is established above said tapping passage and said head may be fully tapped through said tapping passage with said furnace tilted less than 15° to said vertical axis, and a discharge outlet closure mounted externally of said passage and having a closure surface, said closure being movable relative to said discharge outlet towards said inner end to a first position in which said closure surface engages said passage wall at said outer end to fully close said discharge outlet, and away from said inner end to a second position spaced apart from said passage wall.

5. A furnace according to claim 4, further including a support frame in said wall means for mounting said tapping assembly, a shaft mounted for rotary movement in said supporting frame, a closure arm rigidly mounted on said shaft for movement therewith, said closure being mounted on a free end of said arm, remote from said shaft, a hydraulic cylinder mounted on said frame having a slideable piston operably connected to said shaft, whereby sliding movement of said piston relative to said cylinder effects a rotary movement of said shaft to pivot said closure arm, a gas passage extending internally of said shaft communicating with a gas conduit in said closure arm, said gas conduit terminating in a gas injection nozzle in said closure and a gas inlet in said gas passage adapted to communicate with a source of gas.

6. A metallurgical furnace including:

a furnace floor and a furnace wall means extending generally upwardly about said floor, said furnace having a vertical axis and a horizontal axis, means mounting the furnace for pivotal tilting movement about said horizontal axis between a non-tilted, normal upright position, and a tilted discharge position with said furnace tilted less than 15° to said vertical axis, a hearth zone defined between said floor and wall means adapted to house a bath of liquid metal of predetermined volume, said hearth zone having an upper end defining a predetermined upper level for said bath and for a layer of liquid slag floating on said upper level, when said furnace is in a non-tilted, normal upright position, said hearth zone having a lower end adjacent said floor, a tapping passage extending through said wall means from a liquid metal discharge outlet at an outer end into said lower end of said hearth zone, at an inner end, said discharge outlet being defined by an outwardly facing passage wall and said passage at said outer end, said tapping passage being disposed generally parallel to said horizontal axis and vertically below said predetermined upper level, when said furance is in said non-tilted, normal, upright position, a discharge outlet closure having a closure surface and being pivotally mounted externally of said passage for pivotal to and fro movement towards and away from said furnace wall means between a first position in which said closure surface engages said passage wall at said outer end to fully close said discharge outlet, and a second position spaced apart from said passage wall.

7. A method of discharging a metallurgical furnace with avoidance of slag entrainment in the out flow of liquid metal comprising:

(i) providing a furnace having a furnace floor and a furnace wall means extending generally upwardly about said floor, said furnace being mounted for pivotal tilting movement about a horizontal axis relative to a vertical axis, and said furnace having a tapping passage including a tapping outlet defined by said passage and an outwardly facing passage wall, said tapping passage being disposed in said furnace wall means generally parallel to said horizontal axis, said tapping passage being disposed in a lowermost part of said wall means below the upper level of liquid metal in said furnace, said tapping passage being temporarily plugged with a refractory plugging material and said tapping outlet being fully closed by a closure mounted for to and fro movement towards and away from said outlet, said closure having a closure surface engaging said passage wall, (ii) injecting a gas through said closure into said spout and along said passage at a pressure effective to eject said plugging material from said passage, (iii) moving said closure surface away from said passage wall to open said outlet and tilting said furnace about said horizontal axis at an angle up to about 15° to said vertical axis, to lower said outlet and allow liquid metal to flow out of said furnace along said tapping passage, and (iv) restoring said furnace to its upright position.

8. A method according to claim 7, wherein (ii) comprises injecting air at a pressure of 60 to 100 psi into said passage.

9. A method according to claim 8, wherein said angle is about 12.5° to said vertical axis.

10. An assembly for tapping a liquid metal from a metallurgical furnace comprising:

a refractory member adapted to be mounted in a furnace wall, said member having a tapping passage therethrough, said passage having an inner end adapted to communicate with the interior of the furnace and a spout at an outer end, a supporting frame, a shaft mounted for rotary movement in said frame and a closure arm rigidly mounted on said shaft, a spout closure mounted on said arm for pivotal movement with said shaft towards and away from said spout, to close and open said spout, gas conduit means extending through said spout closure for injection of gas into said tapping passage, said gas conduit means including a gas inlet adapted to communicate with a source of gas, said gas conduit means including a gas passage extending internally of said shaft and closure arm, and a gas inlet defined in said shaft.

11. A metallurgical furnace having a furnace floor and a furnace wall means extending generally upwardly about said floor, said furnace having a vertical axis and a horizontal axis and being mounted for pivotal tilting movement about said horizontal axis, a hearth zone defined between said floor and wall means adapted to house a bath of liquid metal, said hearth zone defining a predetermined upper level for said bath, a tapping assembly mounted in said wall means, comprising a refractory member having a tapping passage therethrough defining a spout for delivery of liquid metal, from said hearth zone, said tapping passage being disposed generally parallel to said horizontal axis, in said non-tilted position, vertically below and remove from said predetermined upper level in a lower-most region of said hearth zone such that a head of liquid metal is established above said tapping passage and said head may be fully tapped through said tapping passage with said furnace tilted less than 15° to said vertical axis, a supporting frame in said wall means for mounting said tapping assembly, a shaft mounted for rotary movement in said supporting frame, a closure arm rigidly mounted on said shaft for movement therewith, a spout closure mounted on a free end of said arm, remote from said shaft, said spout closure being movable with said rotary movement of said shaft, towards and away from said spout to close and open said spout, and a gas passage extending internally of said shaft communicating with a gas conduit in said closure arm, said gas conduit terminating in a gas injection nozzle in said spout closure and a gas inlet in said gas passage adapted to communicate with a source of gas.

12. A furnace according to claim 11, further including a hydraulic cylinder mounted on said frame having a slidable piston operably connected to said shaft, whereby sliding movement of said piston relative to said cylinder effects a rotary movement of said shaft to pivot said closure arm.

13. A metallurgical furnace including:

a furnace floor and a furnace wall means extending generally upwardly about said floor, said furance having a vertical axis and a horizontal axis, means mounting the furnace for pivotal tilting movement about said horizontal axis between a non-tilted, normal upright position, and a tilted discharge position with said furnace tilted less than 15° to said vertical axis, a hearth zone defined between said floor and wall means adapted to house a bath of liquid metal of predetermined volume, said hearth-zone having an upper end defining a predetermined upper level for said bath and for a layer of liquid slag floating on said upper level, when said furance is in a non-tilted, normal upright position, said hearth zone having a lower end adjacent said floor, a tapping passage extending through said wall means from a spout at an outer end into said lower end of said hearth zone, at an inner end, said tapping passage being disposed generally parallel to said horizontal axis and vertically below said predetermined upper level, when said furance is in said non-tilted, normal, upright position, a supporting frame in said wall means, a shaft mounted for rotary movement in said supporting frame, a closure arm rigidly mounted on said shaft for movement therewith, a spout closure mounted on a free end of said arm remote from said shaft; said spout closure being movable with said rotary movement of said shaft, towards and away from said spout to close and open said spout, and a gas passage extending internally of said shaft communicating with a gas conduit in said closure arm, said gas conduit terminating in a gas injection nozzle in said spout closure and a gas inlet in said gas passage adapted to communicate with a source of gas.

* * * * *